United States Patent [19]

Rumsey

[11] 4,018,138

[45] Apr. 19, 1977

[54] RADIAL PISTON PUMP/MOTORS

[76] Inventor: Rollin Douglas Rumsey, 138 Summer St., Buffalo, N.Y. 14222

[22] Filed: Sept. 22, 1975

[21] Appl. No.: 615,405

Related U.S. Application Data

[62] Division of Ser. No. 108,089, Jan. 20, 1971, Pat. No. 3,935,794.

[52] U.S. Cl. ..... 91/488; 91/497

[51] Int. Cl.[2] ..... F01B 13/06

[58] Field of Search ..... 91/484, 485, 498, 488, 91/489, 482, 497

[56] References Cited

UNITED STATES PATENTS

| | | | |
|---|---|---|---|
| 2,064,299 | 12/1936 | Ferris et al. | 91/484 |
| 2,126,722 | 8/1938 | Benedek | 91/498 |
| 2,821,145 | 1/1958 | Douglas | 91/489 |
| 3,084,633 | 4/1963 | Henrichson | 91/498 |
| 3,211,105 | 10/1965 | Bush et al. | 91/482 |
| 3,744,378 | 7/1973 | Douglas | 91/484 |
| 3,777,624 | 12/1973 | Dixon | 91/488 |
| 3,875,852 | 4/1975 | Bosch | 91/498 |

*Primary Examiner*—William L. Freeh
*Attorney, Agent, or Firm*—Hill, Gross, Simpson, Van Santen, Steadman, Chiara & Simpson

[57] ABSTRACT

In a pump or motor assembly having telescoped slidably relatively rotative surfaces whereby one of the members supports the other member for relative rotation and one of the members has passage means for hydraulic pressure fluid. Hydraulic bearing means between the surfaces in communication with the pressure fluid passage have distribution of hydraulic pressure fluid to the bearing means controlled by valve means to improve efficiency of the hydraulic bearing means to counteract off-center forces. In a preferred arrangement the bearing means comprise circumferentially spaced pockets in one of the relatively rotative surfaces, and the valve means control distribution of hydraulic pressure fluid to the pockets by modulating lowered pressure in any of the pockets.

15 Claims, 11 Drawing Figures

FIG. 9
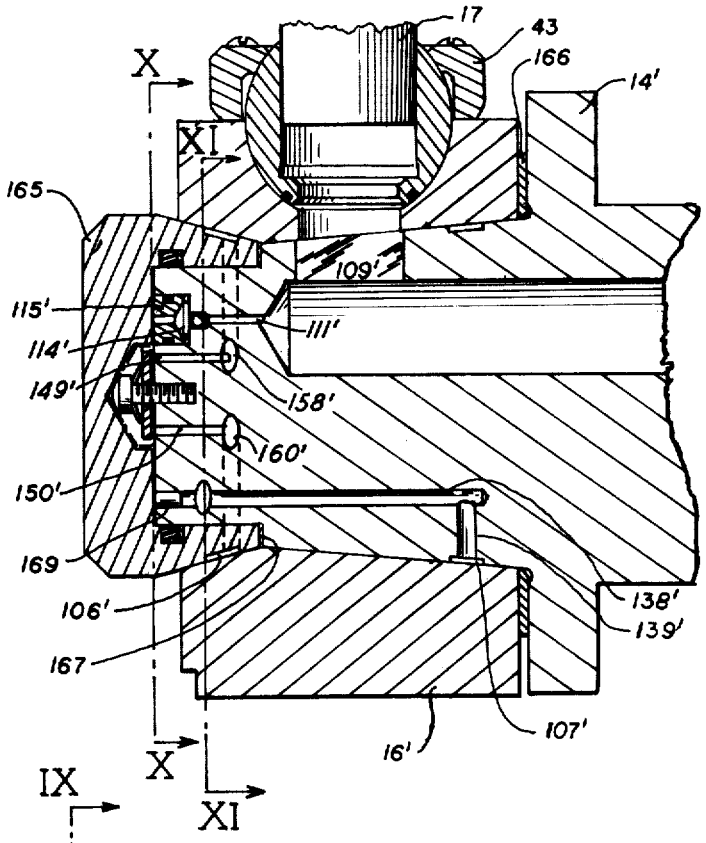
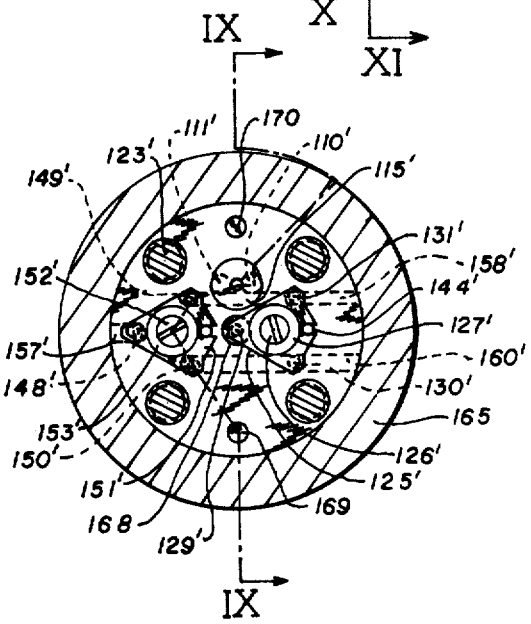
FIG. 10
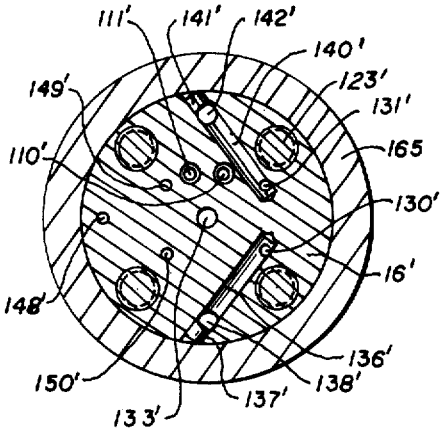
FIG. 11

RADIAL PISTON PUMP/MOTORS

This application is a division of my copending application Ser. No. 108,089 filed Jan. 20, 1971, now U.S. Pat. No. 3,935,794.

This invention relates to radial piston fluid power devices and is particularly concerned with such devices having unusually high speed and efficiency capabilities.

There are many uses where it is desirable to operate hydraulic motors and pumps at higher speeds than is currently possible. For example, present hydraulic pumps are unable to operate without reduction gearing from diesel and gasoline engines. As a result the use of fluid power on mobile equipment is restricted largely to accessory drives.

An object of the invention is to provide complete hydraulic balance of all working parts thereby eliminating wear.

It is a further object of the invention to provide a simplified shuttle control valving system for centering the rotor and reducing hydrostatic bearing flow rates and losses to a minimum.

Another object is to improve the operation of radial piston pumps by means of new and improved hydrostatic bearing means and control valving therefor.

Other objects, features and advantages of the present invention will be readily apparent from the following detailed description of certain preferred embodiments thereof taken in conjunction with the accompanying drawings in which:

FIG. 9 is a fragmentary detail section substantially similar to FIG. 2 but illustrating a modification and taken along substantially the line IX—IX of FIG. 10.

FIG. 10 is an end elevational and sectional view taken substantially along the line X—X of FIG. 9.

FIG. 11 is a sectional view taken substantially along the line of XI—XI of FIG. 9.

Figure 1:
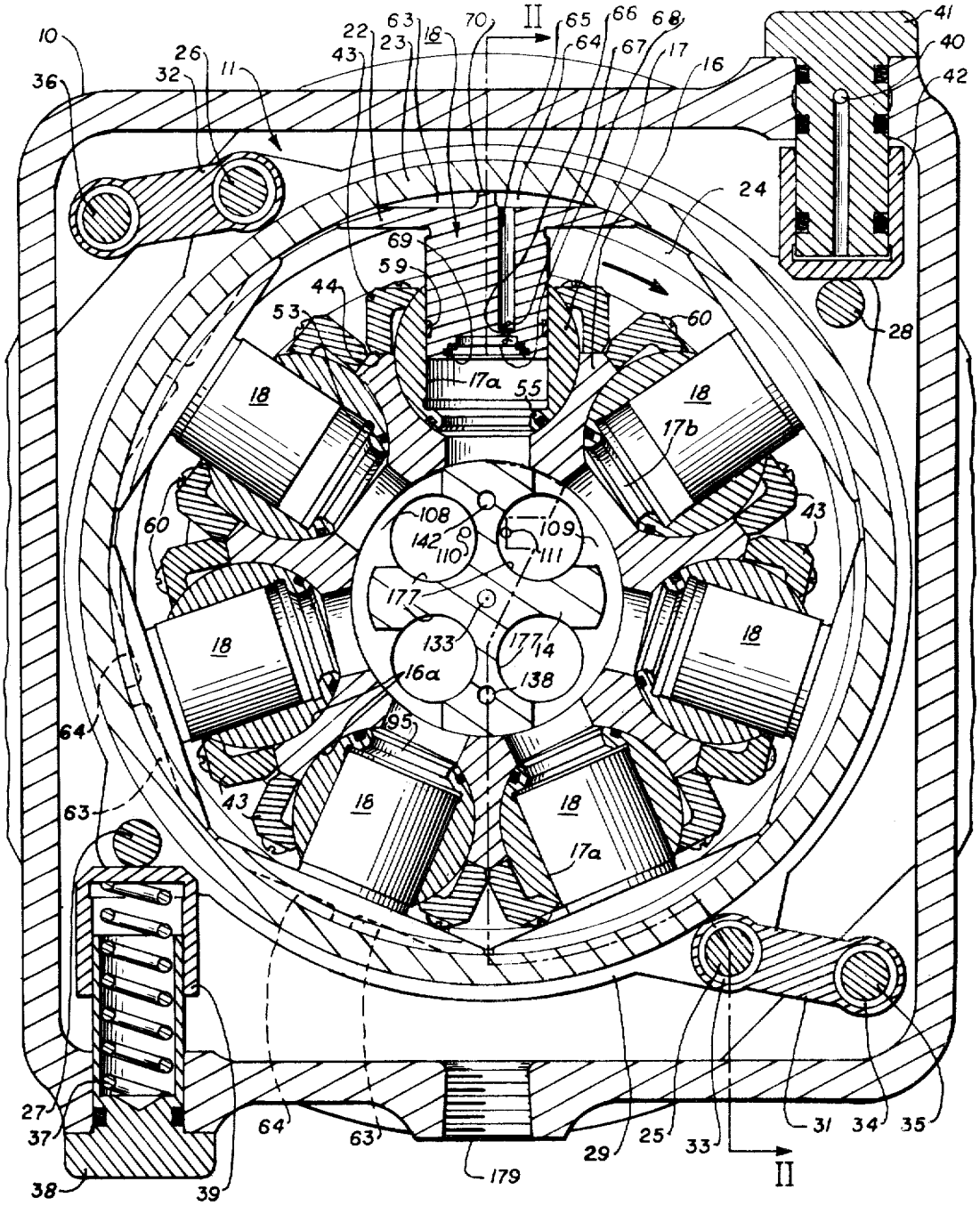
FIG. 1 is a sectional elevational view through a pump/motor embodying features of the invention, and taken substantially along the line I–I of FIG. 2.
Figure 2:
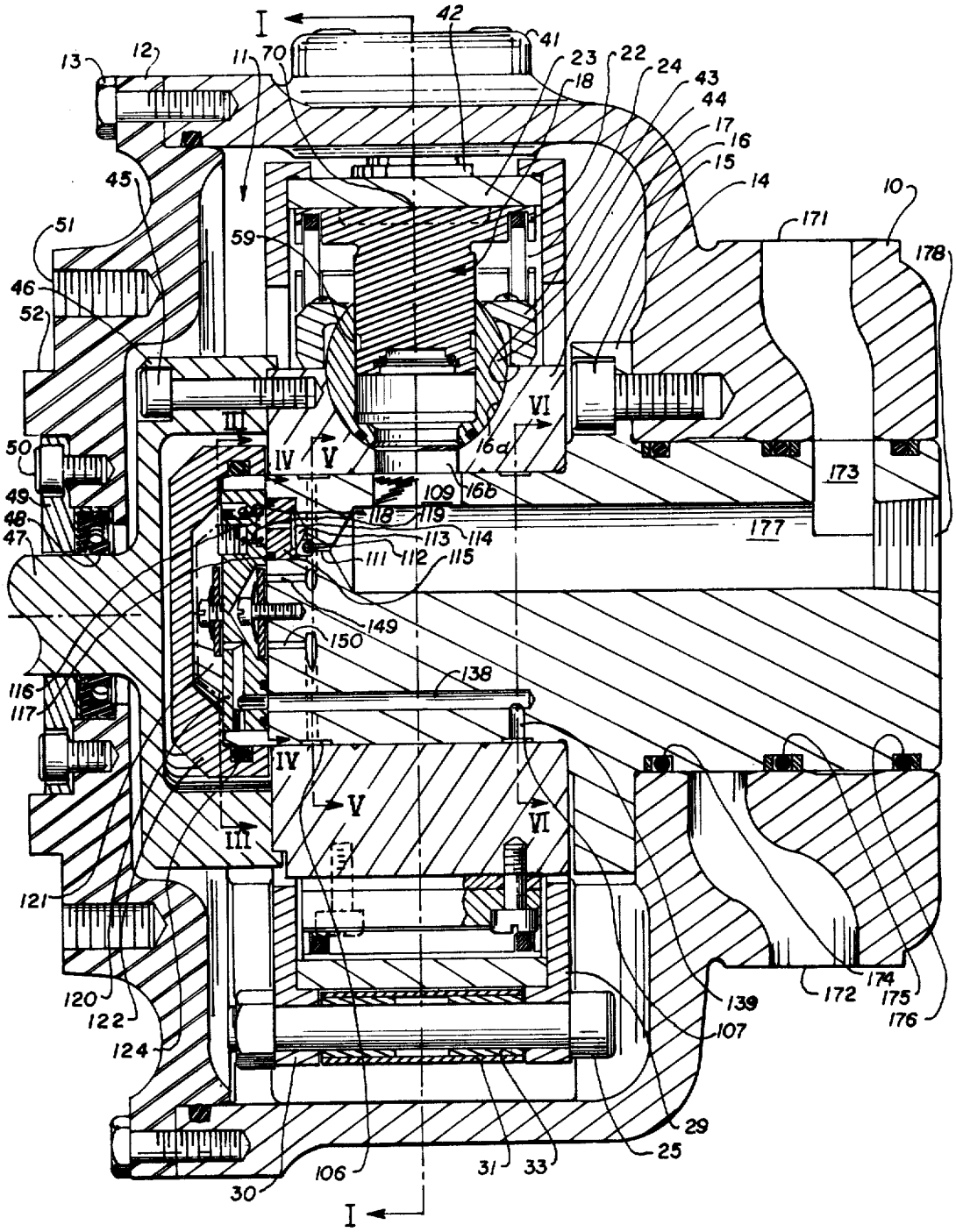
FIG. 2 is a longitudinal developed sectional detail view taken substantially along the line II—II of FIG. 1.

A hydraulic pump/motor embodying features of the invention and as exemplified in FIGS. 1 and 2 has a housing comprising a generally cup shaped body 10 of suitable size defining therein a chamber 11 closed at one end by an end closure member disk 12 held in place by bolts 13 and at the opposite end by a pintle valve plug member 14 attached to body member 10 by bolts 15. Surrounding and journalled in relatively rotary relation on the inwardly protruding stem of valve member 14 is a spider rotor member 16 equipped on its outer periphery with a number of arcuately surfaced hemispherical, pockets 16*a* in which cylinder members 17 are received having bearing surfaces complementary to and riding in angularly slideable relation on the surfaces defining the pockets. Each cylinder member has a radially outwardly opeing cylinder bore 17*a* and within which a piston 18 is reciprocably engaged. Each piston 18 carries a rectangular flanged end portion or slipper 22 the outer surface of which is arcuately complementally shaped to mate with the interior cylindrical raceway 23 against which they are gently held by hold down ring 24. Said raceway is calmped by bolts 25, 26, 27, 28, between stiffening flanges 29 and 30 which are pivotally mounted using a straight line motion 4-bar Watt's linkage consisting of links 31 and 32 journalled on bearings 33 and 34 with bolts 25 and 26 and pins 35 and 36 mounted in housing 10.

In a pressure compensated pump version of the invention, raceway 23 would normally be biased to maximum pumping stroke capacity by means of spring member 37 housed in bolted plug cartridge 38 suitably secured in place as by means of screws (not shown) and acting against sleeve cap 39 and bolt 27. As pressure reaches the required level a control valve not shown normally will apply pressure from a suitable source of port 40 in piston cartridge 41 wherein it would act upon cylinder sleeve 42 to force it against bolt 28 and move piston raceway 23 toward a piston of zero eccentricity or stroke thereby reducing pump delivery volume and pressure. In a servo version of the invention, spring cartridge 38 could be replaced with a piston cartridge similar to 41 wherein the control ports would be connected respectively to the output control ports of a servovalve by means of which the pump's eccentricity could be adjusted either side of zero thereby providing complete flow reversal.

Cylinder sleeves 17 are conveniently held in place by retainer members 43, clamped by screws 60 to rotor 16 and shimmed as necessary at interface 44 to provide free pivotal action with minimal looseness or clearance. Rotor 16 is connected by cap screws 45 to a flanged shaft member 46 by which power can be applied to or taken from the machine by shaft 47, which is sealingly engaged with the housing by seal means 48 clamped in place by seal retainer 49 held down by cap screws 50. Mounting of the pump/motor is provided by tapped mounting holes 51 and pilot diameter 52.

Means for effecting fluid communication between the valve means provided by the pintle 14 and the cylinder bores 17*a* and thereby with the radially inner ends of the pistons 18, include respective ports 17*b* at the radially inner ends of the cylinder member 17 concentrically aligned with the cylinder bores 17*a* and extending to and aligned with respective ports 16*b* in the rotor 16. The rotor ports 16*b* are of substantially smaller diameter than the cylinder bores 17*a* and communicate with the valve means provided by the pintle 14.

Sealing between the pivotal cylinder members 17 and the rotor 16 may be accomplished by means of respective annular seals 53 (FIGS. 1 and 2) mounted in assembly with the cylinder members in respective annular solid portions 55 constricting the inner ends of the bores 17*a* and defining the respective ports 17*b*. Each of the seals 53 has an outside diameter substantially equal to the cylinder bore 17*a* in order to establish hydraulic balance. Such balance may be minutely adjusted by changing the seal groove and seal diameter to slightly more or less than the cylinder diameter, as required to match centrifugal force, to equalize wear patterns etc. In a preferred embodiment especially suitable for use in a relatively low speed version of the pump/motor, the seal 53 may comprise a ring constructed of glass-filled Teflon modified with small amounts of molybdenum-disulphide or cadmium.

For maximum life and minimum wear it is desirable that mating relatively moving parts be constructed of different materials which in high pressure hydraulic machinery is often a difficult task because of the high strengths required on many of the members, extremely close clearance and problems of differential thermal expansion and the need to minimize scratching caused by entrained dirt or wear particles. The present invention overcomes most of the above problem areas when the pintle valve 14, cylinder sleeves 17, cylindrical raceway 23, and hold down rings 24 are constructed of heat treated steel and rotor 16 and pistons 18 are made from an alloy cast iron such as nodular of Mechanite. Piston seal ring 59, if used, may also be iron and cylinder seal ring 53'' may be chrome plated iron, steel, or beryllium copper.

The complete pumping force generated by the pistons 18 is reacted by their flange extension portion or shoe 22 onto circular raceway 23 while sliding at high speed. Since the spherical portion of the cylinder sleeves produces a certain amount of resistance to pivoting action—even though hydraulically balanced—due to friction at seal 53 and as a result of centrifugal force generated on the sleeves themselves against their hold down retainers 43 which contribute an additional small friction force, there results an uneven loading on the piston shoe 22. It is therefore extremely desirable that this uneven or cocking force does not cause one edge of the shoe to bind or drag.

An improved hydrostatic shoe design is shown on piston 18, FIGS. 1 and 2 wherein the hydrostatic pad is divided into two portions 63 and 64 respectively. The leading pad 64 is fed with fluid through passageway 65 from orifice 66 kept from clogging by floating wire 67 and screen 68 held in place by snap ring 69. Trailing pad 63 is fed from pad 64 through restrictive channel 70 in the form of a notch.

In order to assure smooth running combined with minimum friction and leadage at the interface of pintle valve 14 and rotor 16 a pair of hydrostatic bearings 106 and 107 are employed. In this instance a three way flow control or shuttle valve is employed for each bearing.

In operation of the pump/motor, relative rotation of the rotor 16 and the pintle valve member 14 progressively advances the rotor ports **16*b* past the pintle valve fluid transfer zones 108 and 109, best visualized in FIG. 1**.

Referring to FIG. 1, the mode of operation of the bearings 106 and 107 follows: pressurized fluid is selected from the higher pressure of the two pintle valve zones 108 and 109 through passages 110 and 111 respectively each of which utilizes a ball check valve such as 112 FIG. 2 to permit flow into common chamber 113 and prevent backflow into the lower pressure zone. High pressure fluid then flows through screen 114 and through an opening in plug 115 to a second chamber 116 sealed by O ring 117 thence through parallel orifices 118 and 119 located in distributor plate 120.

Figure 3:
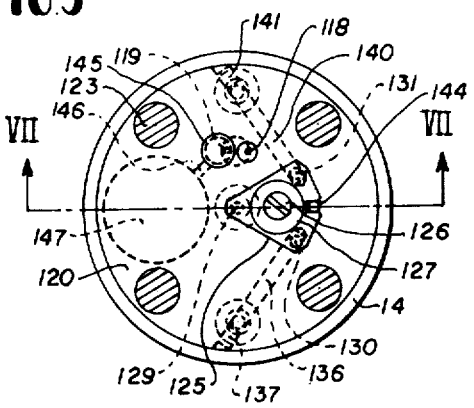
FIG. 3 is an end elevational and sectional view of the pintle valve taken substantially along line III—III of FIG. 2.
Figure 4:
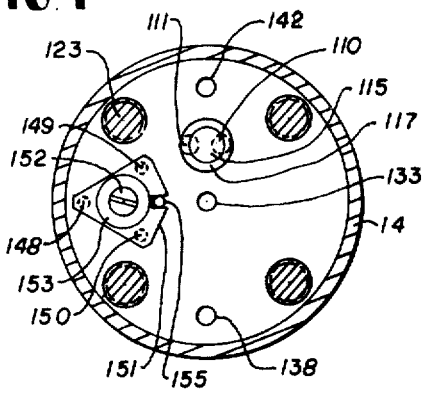
FIG. 4 is an end elevational and sectional view of the pintle taken substantially along line IV—IV of FIG. 2.
Figure 5:
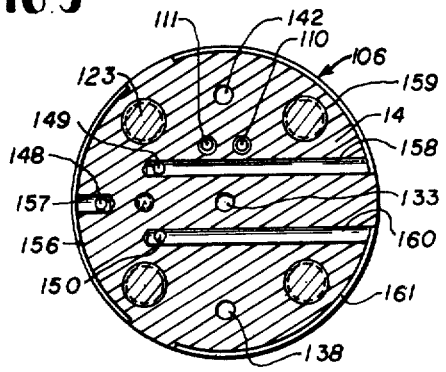
FIG. 5 is a sectional view of the pintle taken substantially along line V—V of FIG. 2.
Figure 6:
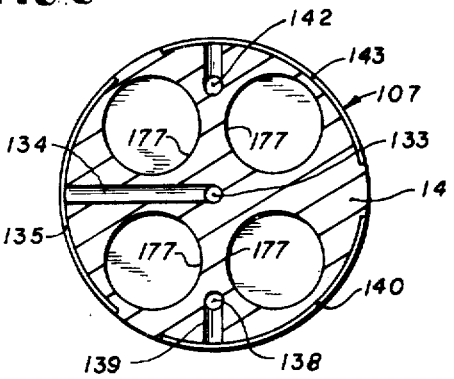
FIG. 6 is a sectional view of the pintle taken along line VI—VI of FIG. 2.
Figure 7:
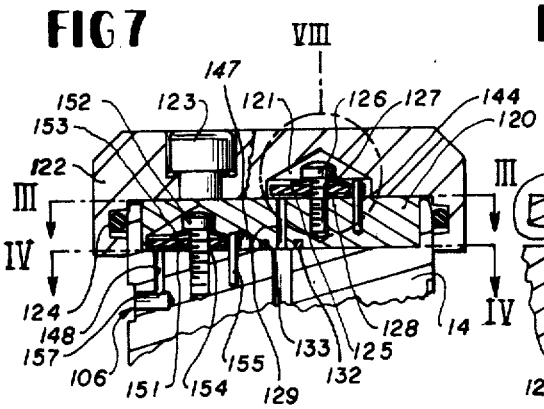
FIG. 7 is a horizontal sectional view taken substantially along line VII—VII of FIG. 3 and is essentially 90 degrees to the section of FIG. 2.

Orifice 118 supplies fluid to the chamber 21 above plate 120 formed by retainer cap 122 held down by cap screws such as 123 and sealed by O ring 124, FIG. 7. Said fluid is thus exposed to the area covered by triangular rocker 125 which is resiliently clamped by screw 126 and spring 127 against spacer washer 128 (approx. 0.002 inches thick) in a partial blocking position above ports 129, 130, and 131—refer FIG. 3. Port 129 sealingly connects by O ring 132 directly to drilled passage 133 in FIGS. 4 and 5 to FIGS. 6 where it connects through cross port 134 to hydrostatic pocket 135 of bearing 107. Port 130 connects to cross hole 136 blocked at its end by plug 137 thence through drilled passage 138 to cross port 139 and to pocket 140 of bearing 107. Port 131 similarly connects to cross hold 140 also blocked by a plug 141 thence through passage 142 to pocket 143 of bearing 107.

Figure 8:
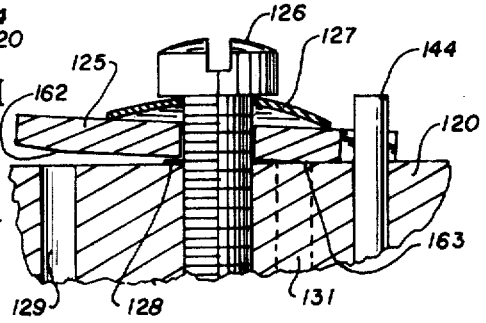
FIG. 8 is an enlarged sectional detail view of substantially the area VIII of FIG. 7.

If the rotor 16 is forced off center as for example by imperfect hydraulic balance such that the clearance at bearing area 107 is reduced on the side of pocket 135 and increased on the opposite side which is served by both pockets 140 and 143, the pressure in 135 will increase due to reduced leakage and the pressure in 140 and 143 will decrease because of increased leakage through the larger clearance. These pressure changes will result in a larger pressure drop between chamber 121 and ports 130 and 131 and a smaller drop between 121 and port 129 with the result that rocker disc 125 will tilt as shown in FIG. 8 in such a manner as to modulate lowered pressure in the pockets 140 and 143 by practically closing ports 130 and 131 and opening wide above port 129 thereby reducing the flow and pressure still more to pockets 140 and 143 and increasing both flow and pressure to pocket 135 which in turn will resist the unbalance force on the rotor and tend to restore it to center.

The action would be similar but in reverse if the clearance was wide at pocket 135 and close at both pockets 140 and 143, in which case the rocker would close off only port 129 and leave the others open relatively equal amounts. The same performance sequence can occur under any combination since the rocker 125 is triangularly symmetrical except for the slot which accommodates anti-rotation pin 144. It may further be noted that in a preferred embodiment the underside of rocker 125 should be slightly chamferred as at 162 and 163, FIG. 8, in order that more perfect flow blocking may occur.

Operation of bearing 106 is similar to 107. However in this instance supply fluid passes through orifice 119 in plate 120 into a bore sealed by plug screw 145, FIG. 3, thence through cross hole 146 into valve chamber 147, FIG. 7, thence into ports 148, 149, or 150 as directed by valve rocker 151, FIG. 4, held by screw 152 and spring washer 153 against spacer washer 154 and prevented from turning by pin 155. Port 148 communicates with pocket 156 of bearing 106 by cross hole 157, FIG. 5, port 149 similarly through hole 158 to bearing pocket 159 and port 150 through hole 160 to pocket 161.

It may thus be realized that a considerable reduction in hydrostatic bearing fluid requirements is assured by the above described novel valving arrangement as well as providing the potential of greater centering force combined with minimum clogging, because only a single somewhat larger orifice is required per bearing in lieu of the normal practice of four orifices per bearing.

One of the difficulties encountered on hydraulic machinery utilizing pintle valves lies in the fact that the clearance between the rotor and pintle must be held to very close tolerance and if dirt enters this clearance scoring and/or rapid wear normally follows with the result that one part or the other must be replaced. Since both parts are usually relatively complex and expensive, the cost of maintenance repair is high compared to machines using face valving which frequently may simply be refaced and put back into service. It is an object of a further innovation in the present invention to overcome the above problem by the use of an hourglass pintle shown in FIG. 9 wherein the pintle member consists of two parts, stem 14' and cap member 165 each of which have conical exterior surfaces in the area occupied by the rotor 16' which is carried on hydrostatic bearings 106' and 107'. Since pintles are characteristically quite weak and deflect appreciably, the use of a tapered section approximately doubles the strength hence the pressure capability of the machine.

Operation of the bearings 106' and 107' is basically similar to those for the cylindrical pintle 14 with the exception that the individual orifices 118 and 119 have been eliminated. It will be noted that these bearings are now capable of carrying thrust and that the initial running clearance is adjustable by selective fitting of spacer 166 and by shims 167. The function of spacer 166 is to assure that the rotor under conditions of shock for example cannot climb too far up the pintle taper and bind since the taper angle is a borderline locking taper as shown. The structure controlling bearing 106' is practically identical 106 as may be noted by comparing FIGS. 2, 4, 5 and 7 with FIGS. 9 and 10. The structure controlling 107' differs slightly from 107 primarily as a result of the elimination of manifold plate 120 and is as follows: Fluid from pintle ports exemplified by 109' enters through passages 110' and 111' controlled by check valves, through screen 114', thence through the drilled center of plug 115' to the clearance area between the pintle 14' and its end cap 165. The fluid is now selectively allowed to flow into ports 129', 130' and 131' as regulated by pressure control valve rocker 125'. Port 129' is formed by a cored plug 168 inserted in the larger drilled passage 133', into which the fluid expands, thence proceeds to its appropriate pocket on bearing 107'. Metered fluid entering port 130' flows into cross port 136' closed by plug 137' at its outer end at which point the fluid flows into drilled passage 138' which is closed at its beginning by plug 169, said fluid again proceeding through 138' to its associated pocket in bearing 107'. The flow through port 131' is similar to 130', port 142' being blocked by plug 170 at the surface.

It will be understood that in the above described bearing control system that the major pressure drop, approximately 50 percent or more of the pressure available, will occur at the junction of the valve rocker member and its associated ports and that the total flow to each hydrostatic bearing will be approximately equal in spite of the fact that the taper angles, hence projected areas of the bearings differ by approximately the ratio of three to one. The reason for this seeming paradox is the fact that the rotor to pintle valving interface is on the pintle member and its projected area also develops a thrust force in opposition to bearing 106' — hence bearing 106' must produce a thrust equal to 107' plus the valving interface area to maintain floating balance.

Fluid flow ports 171 and 172 in housing 10, FIG. 2, connect the machine to its external circuit. Said ports connect to the pintle valve 14 by means of milled slots such as 173 which are sealed from one another by seals 174, 175 and 176. Fluid flows into the pumping section through longitudinal drilled passages 177 in the pintle each sealed by a plug 178, there being two of the passages 177 in communication with the fluid transfer valve zone 108 and two of the passages 177 in communication with the fluid transfer zone 109. Any fluid leakage into the housing cavity 11 may be piped off through case drain port 179 to the external system reservoir, (FIG. 1).

It will be understood that modifications and variations may be effected without departing from the scope of the novel concepts of the present invention.

I claim as my invention:

1. In a pump or motor assembly including a housing providing a chamber having therein hydraulically driven and driving members provided with telescoped slidably relatively rotative surfaces whereby one of the members supports the other member for relative running rotation, the members being liable to be affected by off-center forces tending to shift the members eccentrically during rotation, and one of said members having passage means for hydraulic pressure fluid during said running rotation:

hydraulic bearing means between said surfaces at substantially opposite sides of the axis of rotation of said surfaces;

means effecting hydraulic pressure fluid communication between said passage means and said bearing means; and valve means for controlling distribution of hydraulic pressure fluid from said passage means through said communication means to said bearing means to counteract the off-center forces which act to relatively shift said members eccentrically and thereby restrict the bearing means at one side of said axis relative to the bearing means at the other side of said axis;

said valve means operating to increase the flow of hydraulic pressure fluid to the bearing means at the restricted side and to substantially proportionately decrease the flow of hydraulic pressure fluid to the bearing means at said other side, whereby to maintain substantially running rotation of the members.

2. An assembly according to claim 1, wherein said bearing means comprise circumferentially spaced pockets in one of said surfaces, and said valve means controlling distribution of hydraulic pressure fluid to said pockets through said communication means by modulating lowered pressure in any of said pockets.

3. An assembly according to claim 1, wherein said one member comprises a pintle having an end within said chamber, said end having a substantially flat surface with spaced ports opening therethrough, said means effecting communication comprising passages leading from said ports to said bearing means, and said valve means comprising a disk movably mounted on said end.

4. An assembly according to claim 1, wherein said one member cmprises a pintle having an end within said chamber, said end having a substantially flat surface with ports opening therethrough, said means effecting communication comprising passages leading from said ports to said bearing means, and said means, and said valve means comprising a plurality of valve disks mounted on said pintle end.

5. An assembly according to claim 1, wherein said one member comprises a pintle having an end within said chamber, said end having a substantially flat surface with spaced ports opening therethrough, said means effecting communication comprising passages leading from said ports to said bearing means, and said valve means comprising a plurality of valve disks normally biased toward said ports and pressure reponsive during said distribution-controlling.

6. An assembly according to claim 1, wherein said bearing means comprise axially spaced respective arrays of hydrostatic bearing pockets, and said valve means comprising respective valve assemblies for controlling distribution of hydraulic pressure fluid from said passage means to said arrays of pockets.

7. An assembly according to claim 1, wherein said surfaces are cylindrical, and said hydraulic bearing means comprise respective axially spaced annular arrays of hydrostatic pockets in one of said surfaces.

8. An assembly according to claim 1, wherein said surfaces are of generally tapered form, and said bearing means comprising axially spaced circumferential arrays of hydrostatic bearing pockets.

9. An assembly according to claim 1, wherein said one member is in the form of a stationary pintle, said pintle being of generally frustoconical form and having on its smaller end thrust bearing means including means for axially adjusting the thrust bearing means relative to the pintle, said thrust bearing means and said pintle both having surfaces complementary to and in slidably relative rotative relation to surfaces of the other of said members, and said hydraulic bearing means being operative between all of said surfaces.

10. An assembly according to claim 1, wherein said one member having the passage means comprises a pintle, and said valve means being mounted on said pintle.

11. An assembly according to claim 10, including means providing a housing on an end of said pintle within said chamber, and said valve means being within said housing.

12. An assembly according to claim 10, wherein said bearing means comprise a plurality of pockets in the relatively rotative surface of the pintle, and said means effecting communication comprising passages in the pintle controlled by said valve means.

13. An assembly according to claim 8, wherein said surfaces comprise convergent sections, each of said sections having one of said arrays of hydrostatic bearing pockets.

14. An assembly according to claim 13, wherein said one member comprises a pintle having an end within said chamber and provided with relatively low convergence angle frustoconical major length surface convergent toward said end, said valve means carried on said end, and a cap member mounted on said end and enclosing said valve means and having a frustoconical surface converging at a greater angle toward said major length frustoconical surface.

15. An assembly according to claim 13, including means for axially adjustably mounting said cap on said pintle.

* * * * *